US005375928A

United States Patent [19]

Yarng et al.

[11] Patent Number: 5,375,928

[45] Date of Patent: Dec. 27, 1994

[54] HANGING TISSUE CONTAINER HOLDER

[76] Inventors: Peter Yarng; Chin Y. Yang, both of 39 Hunter Point Rd., Pomona, Calif. 91766

[21] Appl. No.: 133,922

[22] Filed: Oct. 12, 1993

[51] Int. Cl.[5] ..... B65D 33/36

[52] U.S. Cl. ..... 383/24; 383/41; 383/67; 206/457; 150/154; 446/73; 221/24

[58] Field of Search ..... 383/24, 41, 66, 67, 383/907; 206/457; 446/72, 73, 74; 150/154; 221/24

[56] References Cited

U.S. PATENT DOCUMENTS

| | | | |
|---|---|---|---|
| D. 152,173 | 12/1948 | Seidler | 383/907 X |
| D. 241,722 | 10/1976 | Becker . | |
| D. 242,989 | 1/1977 | Becker . | |
| D. 306,832 | 3/1990 | Horne . | |
| 821,986 | 5/1906 | Coburn | 383/41 |
| 2,484,776 | 10/1976 | Zent et al. . | |
| 2,515,413 | 7/1950 | Mansfield . | |
| 2,574,345 | 11/1951 | Montgomery | 383/66 X |
| 2,580,982 | 1/1952 | Weiss | 206/457 X |
| 2,622,648 | 12/1952 | Ingram | 383/67 X |
| 3,507,416 | 4/1970 | Douglas et al. . | |
| 4,548,375 | 10/1985 | Moss | 383/24 X |
| 4,570,820 | 2/1986 | Murphy | 383/66 X |
| 4,782,950 | 11/1988 | Santoro . | |
| 5,165,567 | 11/1992 | Richardson et al. | 150/154 X |

*Primary Examiner*—Allan N. Shoap
*Assistant Examiner*—Jes F. Pascua
*Attorney, Agent, or Firm*—Bacon & Thomas

[57] ABSTRACT

A holder for a tissue container is disclosed in which the tissue container is held in an inverted position to enable the tissues to be withdrawn therefrom in a generally downward direction. The holder is formed as a portion of a decorative article which may completely or partially conceal the tissue container. The decorative article may take any aesthetically pleasing form and may comprise a doll-like article. The decorative article has a hanger attached to an upper portion thereof so that the tissue container holder may be supported from above, thereby eliminating the need for a horizontal surface on which to store the tissue container.

8 Claims, 2 Drawing Sheets

HANGING TISSUE CONTAINER HOLDER

BACKGROUND OF THE INVENTION

The present invention relates to a holder for a tissue container, more particularly such a container which also performs a decorative function.

Tissues have become a facet of our daily lives and are available, in a variety of colors and sizes. Typically, a container for the tissues has an opening in an upper portion which enables to the tissues to be withdrawn from the container by pulling them upwardly through the container opening. Although the containers are sold in various sizes, the containers must typically rest on a flat surface, thereby enabling the tissues to be withdrawn upwardly. In many places in the home, or in a vehicle, it is difficult, if not impossible, to find a sufficient area of unused flat surface in which to place the tissue container. Furthermore, if the tissue container is placed in a portion of the house, such as the kitchen, the bathroom or the shower room, the upwardly facing tissues may be exposed to water, thereby rendering them useless.

Thus, the need exists for a tissue container holder which will enable the tissue container to be readily available, but which will not utilize flat surface space and will not expose the tissues to possible moisture damage.

SUMMARY OF THE INVENTION

A holder for a tissue container is disclosed in which the tissue container is held in an inverted position to enable the tissues to be withdrawn therefrom in a generally downward direction. The holder is formed as a portion of a decorative article which may completely or partially conceal the tissue container. The decorative article may take any aesthetically pleasing form and may comprise a doll-like article.

The decorative article has a hanger attached to an upper portion thereof so that the tissue container holder may be supported from above, thereby eliminating the need for a horizontal surface on which to store the tissue container.

In use, the holder is hung in place and a tissue container is placed within the support such that the opening of tile tissue container faces .downwardly. The support defines an opening which is in alignment with the dispensing opening of the tissue container to enable the tissues to be withdrawn therefrom in a generally downward direction. The holder may be formed in various sizes to accommodate the various sizes of tissue containers and/or various places of usage. The holder can be easily mounted in various rooms of a household, as well as a vehicle.

DETAILED DESCRIPTION OF THE PREFERRED EMBODIMENT

Figures 1, 4:
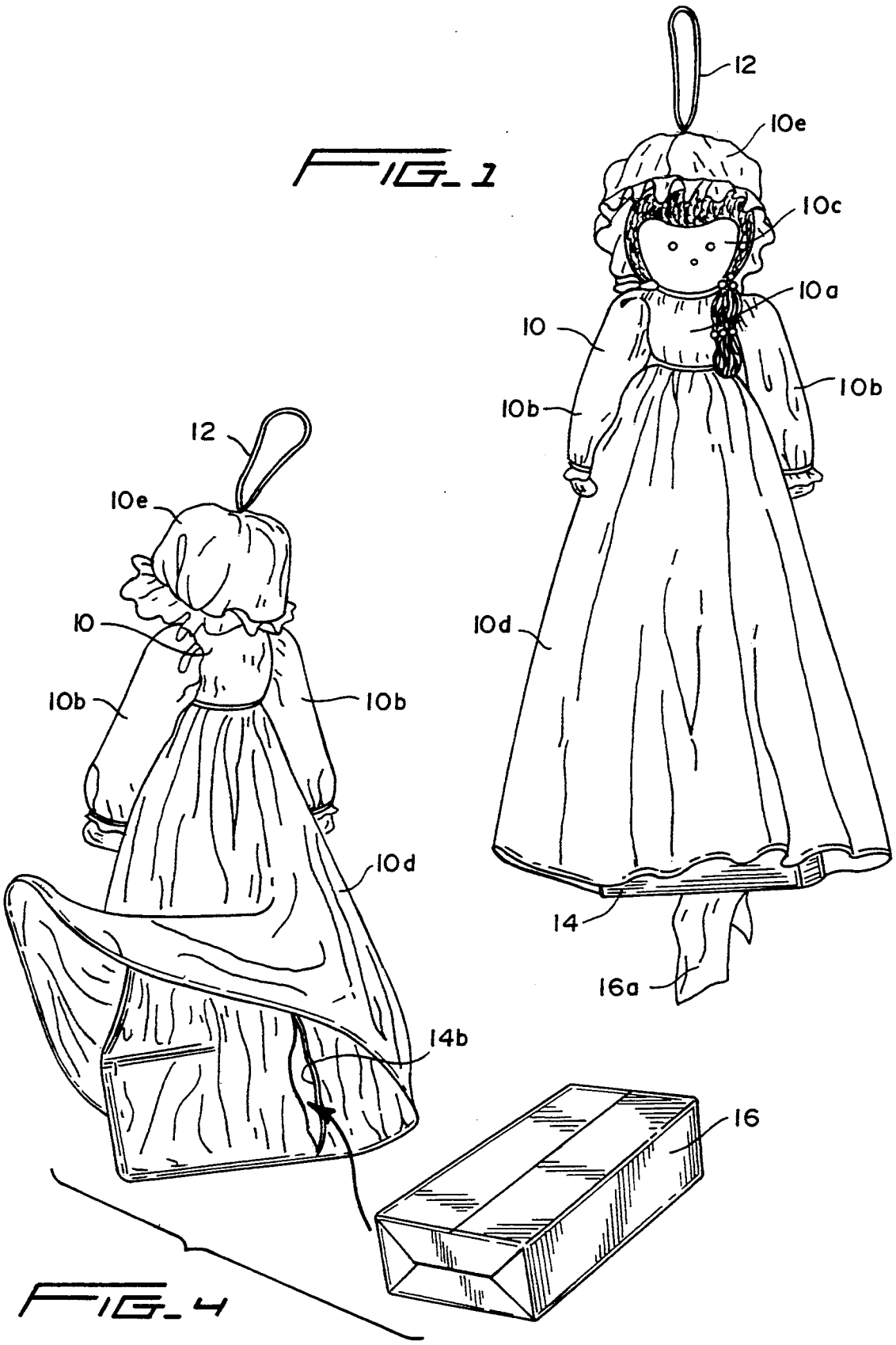
FIG. 1 is a front, perspective view of the tissue container holder according to the present invention.
FIG. 4 is an exploded, perspective view illustrating the installation of the tissue container in the holder according to the present invention.
Figure 2:
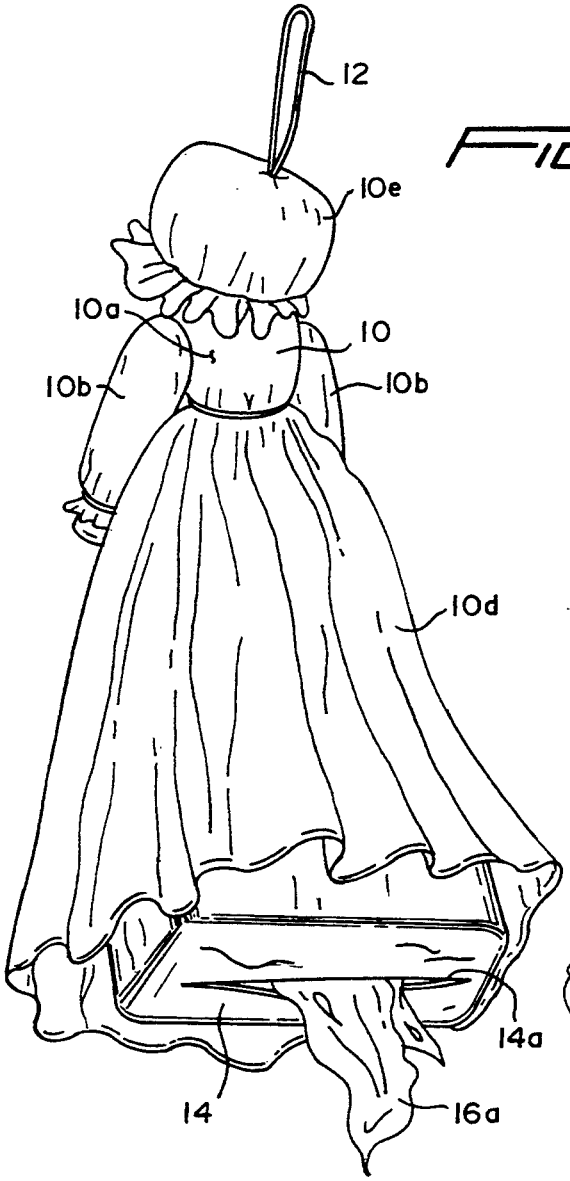
FIG. 2 is a rear, perspective view of the tissue container holder according to the present invention.

As best illustrated in FIGS. 1 and 2, the tissue container holder according to the present invention comprises a decorative article 10, a hanger 12 attached to an upper portion of the decorative article 10 and a tissue container support 14 attached to, or otherwise formed as part of a lower portion of the decorative article 10. As illustrated, the decorative article 10 may comprise a doll-like figure having a body 10*a*, arms 10*b* and a head portion 10*c*. The decorative article may also include items simulating clothing for the doll-like figure, such as skin portion 10*d* and a hat 10*e*. Although the present invention has been illustrated with this doll-like figure, it is to be understood that any decorative article having an aesthetically pleasing appearance may be utilized without exceeding the scope of this invention.

Figure 3:
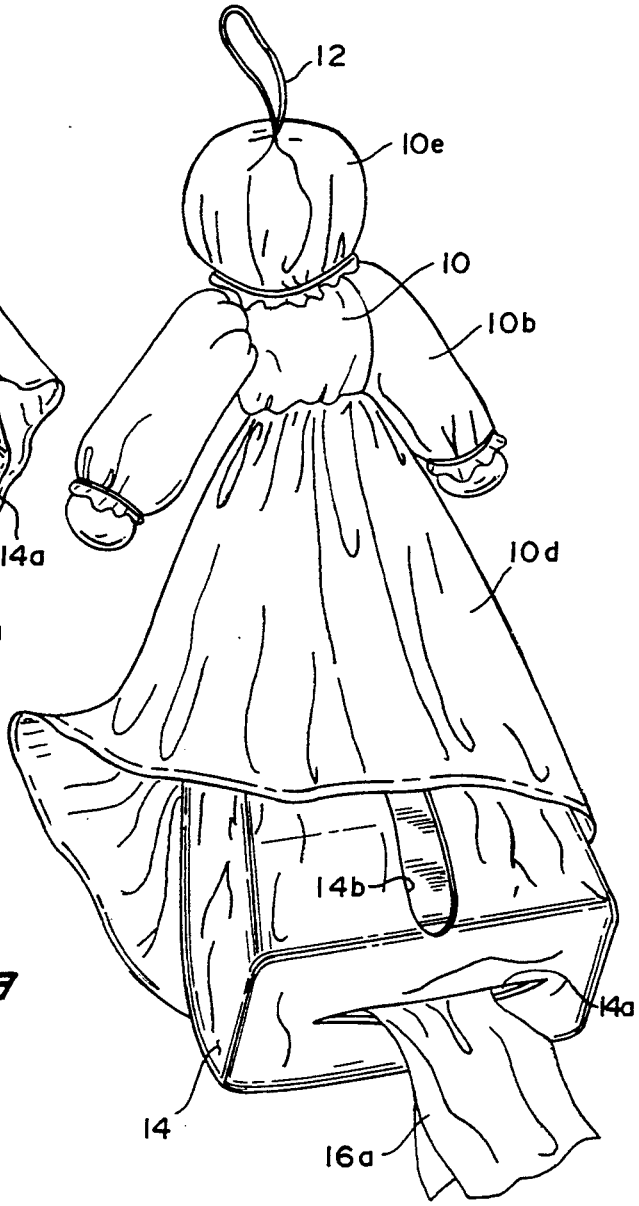
FIG. 3 is a view, similar to FIG. 2, but illustrating the tissue container support.

The support 14 may be formed from a flexible material, such as cloth or the like, and may be formed as a pouch having a bottom portion defining a first opening 14*a* and a side portion defining second opening 14*b*, as best illustrated in FIGS. 3 and 4. Opening 14*a* is located so as to be in general alignment with the dispensing opening (not shown) of the tissue container 16 when the container 16 is placed within the support 14. By placing these respective openings in general alignment with each other, the tissues 16*a* from the tissue container 16 may be easily withdrawn through the opening 14*a*. As best seen in FIG. 4, the tissue container 16 is inverted such that its dispensing opening (not shown) faces generally downwardly and the tissue container 16 is placed into the support 14 through the opening 14*b* which extends generally along a side of the support 14.

Once in position within the support 14, tissue 16*a* is drawn through the opening 14*a* such that it extends exteriorly of the support 14.

The decorative article may be then hung from a known hook or support via the hanger 12, which may be a flexible loop, or the like. Quite obviously, other types of hangers may be utilized to support the tissue container holder without exceeding the scope of this invention. Once hung in position, the user may easily grasp the tissue 16*a* and remove it from the tissue container 16 by pulling it downwardly.

The tissue container holder according to the present invention not only eliminates the need for any support surface on which to support the tissue container, but also provides an aesthetically pleasing appearance within the room in which it is utilized. The decorative article may be formed in various sizes to facilitate its use within household rooms, or vehicles.

The foregoing description is provided for illustrative purposes and should not be construed as in any way limiting this invention, the scope of which is defined solely by the appended claims.

We claim:

1. A hanging tissue dispenser comprising:

a) a decorative article having an upper portion and a lower portion;

b) hanger means located on the decorative article to hang the decorative article such that the lower portion faces generally downwardly;

c) support means located on the decorative article, the support means having a first opening facing generally downwardly; and, d) a tissue container having a dispensing opening located in and supported by the support means such that the dispensing opening is in alignment with the first opening so as to enable the tissues to be withdrawn therefrom in a generally downward direction.

2. The hanging tissue dispenser of claim 1 wherein the hanger means is attached to the upper portion of the decorative article.

3. The hanging tissue dispenser of claim 1 wherein the hanger means comprises a loop of flexible material attached to the upper portion of the decorative article.

4. The hanging tissue dispenser of claim 1 wherein the support means further comprises a second opening to enable the tissue container to be placed into the support means.

5. The hanging tissue dispenser of claim 1 wherein the support means comprises a pouch attached to the decorative article.

6. The hanging tissue dispenser of claim 5 wherein the pouch is comprised of a flexible material.

7. The hanging tissue dispenser of claim 5 wherein the pouch comprises a bottom portion having the first opening.

8. The hanging tissue dispenser of claim 7 wherein the pouch comprises a side portion having a second opening to enable the tissue container to be placed into the pouch such that the dispensing opening is generally aligned with the first opening.

* * * * *